US011236749B2

(12) United States Patent
Sato et al.

(10) Patent No.: US 11,236,749 B2
(45) Date of Patent: Feb. 1, 2022

(54) TIP SEAL AND SCROLL FLUID MACHINE USING SAME

(71) Applicant: MITSUBISHI HEAVY INDUSTRIES THERMAL SYSTEMS, LTD., Tokyo (JP)

(72) Inventors: Hajime Sato, Tokyo (JP); Yohei Hotta, Tokyo (JP); Yoshiyuki Kimata, Tokyo (JP); Takuma Yamashita, Tokyo (JP)

(73) Assignee: MITSUBISHI HEAVY INDUSTRIES THERMAL SYSTEMS, LTD., Tokyo (JP)

( * ) Notice: Subject to any disclaimer, the term of this patent is extended or adjusted under 35 U.S.C. 154(b) by 137 days.

(21) Appl. No.: 16/492,557

(22) PCT Filed: Jun. 21, 2018

(86) PCT No.: PCT/JP2018/023649
§ 371 (c)(1),
(2) Date: Sep. 9, 2019

(87) PCT Pub. No.: WO2019/035277
PCT Pub. Date: Feb. 21, 2019

(65) Prior Publication Data

US 2021/0156382 A1 May 27, 2021

(30) Foreign Application Priority Data

Aug. 18, 2017 (JP) ..... JP2017-158113

(51) Int. Cl.
*F03C 2/00* (2006.01)
*F03C 4/00* (2006.01)
(Continued)

(52) U.S. Cl.
CPC ..... *F04C 18/0284* (2013.01); *F04C 18/0269* (2013.01); *F04C 18/0276* (2013.01);
(Continued)

(58) Field of Classification Search
CPC ..... F04C 18/0207; F04C 18/0215; F04C 18/0269; F04C 18/0276; F04C 18/0284; F04C 23/008; F04C 27/005; F04C 27/007
See application file for complete search history.

(56) References Cited

U.S. PATENT DOCUMENTS 4,477,238 A * 10/1984 Terauchi ..... F04C 18/0276 418/55.2
5,496,161 A 3/1996 Machida et al.
2002/0054821 A1 5/2002 Takeuchi et al.
(Continued)

FOREIGN PATENT DOCUMENTS

EP 2 894 338 A1 7/2015
JP 61-76185 U 5/1986
(Continued)

OTHER PUBLICATIONS

European Communication pursuant to Article 94(3) EPC for European Application No. 18845771.7, dated Aug. 20, 2020.
(Continued)

*Primary Examiner* — Theresa Trieu
(74) *Attorney, Agent, or Firm* — Birch, Stewart, Kolasch & Birch, LLP

(57) ABSTRACT

Provided is a tip seal that makes it possible to improve the durability of a tip seal installed on the tooth tip of a wall even when a continuously inclined section is provided to the wall. The tip seal is provided with: a tip seal inclined section (7A) installed in a groove section of a wall in which the height changes continuously in a spiral direction; and a tip seal flat section (7B) that is installed in a groove section of the wall in which the height is fixed in the spiral direction and that is adjacent to the tip seal inclined section (7A). A recess (8) is formed at a position away from the adjacent area between the tip seal inclined section (7A) and the tip seal flat section (7B).

11 Claims, 9 Drawing Sheets

(51) Int. Cl.

| | |
|---|---|
| ***F04C 2/00*** | (2006.01) |
| ***F04C 18/00*** | (2006.01) |
| ***F04C 18/02*** | (2006.01) |
| ***F04C 27/00*** | (2006.01) |
| *F04C 23/00* | (2006.01) |

(52) U.S. Cl.

CPC ..... *F04C 27/001* (2013.01); *F04C 27/007* (2013.01); *F04C 23/008* (2013.01)

(56) References Cited

U.S. PATENT DOCUMENTS

| | | | | |
|---|---|---|---|---|
| 2003/0021712 | A1 | 1/2003 | Fujita et al. | |
| 2003/0194341 | A1 | 10/2003 | Takeuchi et al. | |
| 2010/0092318 | A1* | 4/2010 | Sato | F04C 27/007 418/55.4 |
| 2010/0172780 | A1* | 7/2010 | Fujita | F04C 27/007 418/55.4 |
| 2020/0309131 | A1 | 10/2020 | Sato et al. | |

FOREIGN PATENT DOCUMENTS

| | | | |
|---|---|---|---|
| JP | 1-119892 | U | 8/1989 |
| JP | 6-235386 | A | 8/1994 |
| JP | 8-28481 | A | 1/1996 |
| JP | 8-177760 | A | 7/1996 |
| JP | 9-250467 | A | 9/1997 |
| JP | 2002-70786 | A | 3/2002 |
| JP | 2002-286778 | A | 9/2002 |
| JP | 2002-303281 | A | 10/2002 |
| JP | 2003-35285 | A | 2/2003 |
| JP | 2005-330850 | A | 12/2005 |
| JP | 2008-240739 | A | 10/2008 |
| JP | 2009-228476 | A | 10/2009 |
| JP | 2010-196663 | A | 9/2010 |
| JP | 2014-80940 | A | 5/2014 |
| JP | 2015-55173 | A | 3/2015 |
| JP | 2018-35737 | A | 3/2018 |

OTHER PUBLICATIONS

International Search Report and Written Opinion of the International Searching Authority for International Application No. PCT/JP2018/023648, dated Sep. 25, 2018, with English translation.

International Search Report and Written Opinion of the International Searching Authority for International Application No. PCT/JP2018/023649, dated Sep. 25, 2018. with English translation.

Japanese Office Action for Japanese Application No. 2017-158113, dated Feb. 6, 2018, with English translation.

Japanese Office Action for Japanese Application No. 2017-158114, dated Feb. 6, 2018, with English translation.

Office Action dated May 4, 2021 issued in related U.S. Appl. No. 16/608,109.

* cited by examiner

TIP SEAL AND SCROLL FLUID MACHINE USING SAME

TECHNICAL FIELD

The present invention relates to a tip seal and a scroll fluid machine using the same.

BACKGROUND ART

In general, a scroll fluid machine is known, in which a fixed scroll member and an orbiting scroll member each having a spiral wall provided on an end plate mesh with each other so as to perform a revolution orbiting movement and a fluid is compressed or expanded.

As the scroll fluid machine, a so-called stepped scroll compressor which is described in PTL 1 is known. In the stepped scroll compressor, step portions are provided at positions of tooth tip surfaces and tooth bottom surfaces of spiral walls of a fixed scroll and an orbiting scroll in a spiral direction and a height on an outer peripheral side of each wall is higher than a height on an inner peripheral side thereof with each step portion as a boundary. In the stepped scroll compressor, compression (three-dimensional compression) is performed not only in a circumferential direction of the wall but also in a height direction thereof, and thus, compared to a general scroll compressor (two-dimensional compression) which does not have the step portion, an amount of displacement increases, and thus, compressor capacity can increase.

CITATION LIST

Patent Literature

[PTL 1] Japanese Unexamined Patent Application Publication No. 2015-55173

SUMMARY OF INVENTION

Technical Problem

However, in a stepped scroll compressor, there is a problem that fluid leakage in a step portion is large. In addition, there is a problem that stress concentrates on a base portion of the step portion and strength decreases.

Meanwhile, the inventors are studying to provide a continuously inclined portion instead of the step portion provided on a wall and an end plate.

A groove portion for accommodating a tip seal is formed on a tooth tip, which is a tip of the wall, along a spiral direction of the wall. During an operation of a scroll compressor, the tip seal comes into contact with a tooth bottom facing the tooth tip while sliding on the tooth bottom, and thus, a fluid leakage is suppressed.

In a case where a flat portion of the wall having a constant height is provided to be adjacent to the inclined portion of the wall, the tip seal is accommodated in the groove portion formed on the inclined portion of the wall and the flat portion of the wall. In this case, even when the wall performs an orbiting movement, a distance between the flat portion of the tip seal and the facing end plate (tooth bottom) is constant. Meanwhile, the inclined portion of the tip seal repeats movements toward and away from the facing end plate (tooth bottom) according to the orbiting movement of the wall. Accordingly, repeated stress is generated in an adjacent region between the flat portion of the tip seal and the inclined portion of the tip seal, and thus, there is a possibility of a damage. In addition, the inclined portion of the tip seal repeats movements toward and away from the facing end plate (tooth bottom), and thus, there is a problem that the inclined portion wears more than the flat portion.

The present invention is made in consideration of the above-described circumstances, and an object thereof is to provide a tip seal and a scroll fluid machine using the same capable of improving durability of the tip seal installed in the tooth tip of the wall even in a case where a continuously inclined portion is provided in the wall.

Solution to Problem

In order to achieve the above-described object, a tip seal and a scroll fluid machine using the same of the present invention adopt the following means.

According to an aspect of the present invention, there is provided a tip seal which is installed in a groove portion formed on a tooth tip of a spiral wall of a scroll fluid machine and is formed of a resin, the seal including: an inclined portion which is installed in the groove portion of the wall whose height is continuously changed in a spiral direction and a flat portion which is installed in the groove portion of the wall whose height is constant in the spiral direction and is adjacent to the inclined portion, in which a concave portion is formed at a position avoiding an adjacent region between the inclined portion and the flat portion.

Even when the spiral wall performs an orbiting movement, a distance between the flat portion of the tip seal and the facing wall portion (tooth bottom) is constant. Meanwhile, the inclined portion of the tip seal repeats movements toward and away from the facing wall portion (tooth bottom) according to the orbiting movement of the spiral wall. Accordingly, repeated stress is generated in the adjacent region between the flat portion and the inclined portion of the tip seal, and thus, there is a possibility of a damage. In addition, in a case where the tip seal is manufactured, when the tip seal is resin-molded and released from a mold, the tip seal is pressed by an extrusion pin and is taken out of the mold. In this case, the concave portion is formed on the surface of the tip seal. If this concave portion is formed in the adjacent region between the flat portion and the inclined portion of the tip seal, stress concentration is generated, and thus, the tip seal is easily damaged. Accordingly, the concave portion is formed at the position avoiding the adjacent region between the inclined portion and the flat portion, and thus, the repeated stress in the adjacent region is reduced, and a risk of damages in the adjacent region can be reduced. The surface of the tip seal on which the concave portion is formed includes a surface of the facing wall portion (tooth bottom) side and a back surface or a side surface thereof.

Moreover, in the tip seal according to the aspect of the present invention, the concave portion is provided at a position away from a connection position between the flat portion and the inclined portion by twice or more width of the flat portion.

If the concave portion is provided at the position away from the connection position between the flat portion and the inclined portion by twice or more width of the flat portion, the repeated stress generated at the connection position does not significantly affect the concave portion, which is preferable. Moreover, the width of the flat portion means a dimension in a direction orthogonal to a longitudinal direction of the tip seal, and is typically the same as a width of the inclined portion.

In addition, in the tip seal according to the aspect of the present invention, the inclined portion is thicker than the flat portion.

The inclined portion repeats movements toward and away from the facing wall portion (tooth bottom), and thus, the inclined portion wears more than the flat portion. Accordingly, the inclined portion is made thicker than the flat portion to improve wear resistance. Moreover, the thickness of each of the inclined portion and the flat portion means a dimension in a standing direction of the wall.

Moreover, in the tip seal according to the aspect of the present invention, the inclined portion is formed of a material having wear resistance higher than that of the flat portion.

The inclined portion repeats movements toward and away from the facing wall portion (tooth bottom), and thus, the inclined portion wears more than the flat portion. Accordingly, the inclined portion is formed of a material having wear resistance higher than that of the flat portion. The material having high wear resistance includes PolyEtherEtherKetone (PEEK) or polytetrafluoroethylene (PTFE) or a material obtained by applying Diamond-LikeCarbon (DLC) coating or PTFE coating to a base material. In general, Polyphenylenesulfide (PPS) or the like is used as a material of the flat portion.

In addition, in the tip seal according to the aspect of the present invention, the tip seal is divided into the inclined portion and the flat portion at a connection position therebetween.

The tip seal is divided into the inclined portion and the flat portion at the connection position therebetween, and thus, it is possible to avoid occurrence of the repeated stress due to bending at the connection position.

In addition, according to another aspect of the present invention, there is provided a scroll fluid machine including: a first scroll member having a first end plate on which a spiral first wall is provided; a second scroll member having a second end plate on which a spiral second wall is provided, the second end plate being disposed to face the first end plate and the second wall meshing with the first wall such that the second scroll member performs a revolution orbiting movement relative to the first scroll member; and an inclined portion in which an inter-facing surface distance between the first end plate and the second end plate facing each other continuously decreases from outer peripheral sides of the first wall and the second wall toward inner peripheral sides thereof, in which the above-described tip seal which comes into contact with a facing tooth bottom to perform sealing for a fluid is provided in a groove portion formed on each tooth tip of the first wall and the second wall corresponding to the inclined portion.

Advantageous Effects of Invention

A concave portion is formed at a position avoiding an adjacent region between an inclined portion of a tip seal and a flat portion of the tip seal, and thus, repeated stress in the adjacent region is reduced, and a risk of damages in the adjacent region can be reduced. The inclined portion of the tip seal is made thicker than the flat portion, and thus, it is possible to improve wear resistance of the inclined portion of the tip seal.

DESCRIPTION OF EMBODIMENTS

Hereinafter, an embodiment according to the present invention will be described with reference to the drawings.

Figure 1A:
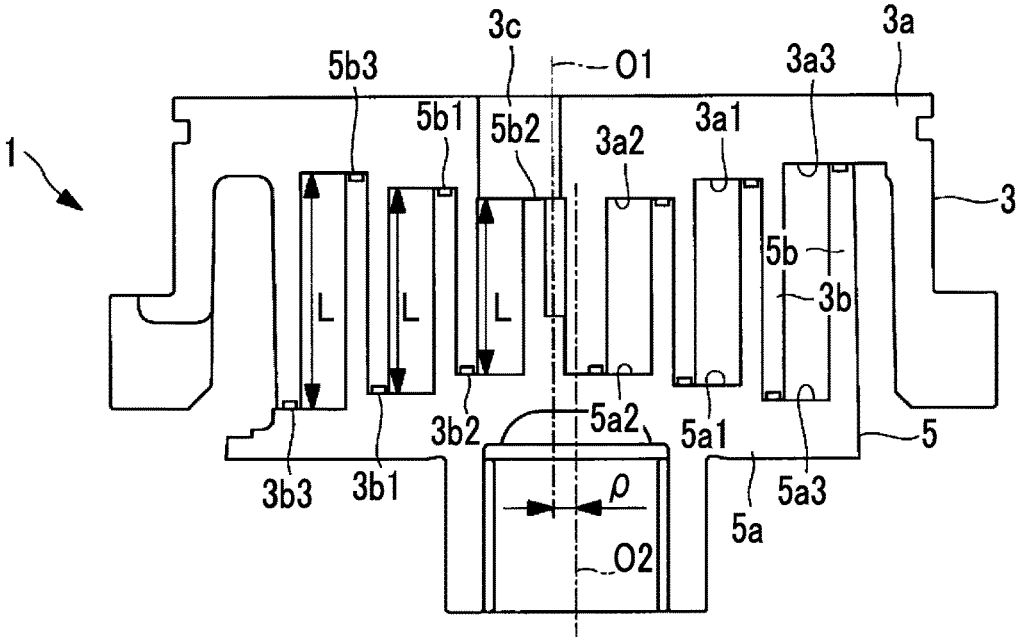
FIG. 1A is longitudinal sectional view showing a fixed scroll and an orbiting scroll of a scroll compressor according to an embodiment of the present invention.
Figure 1B:
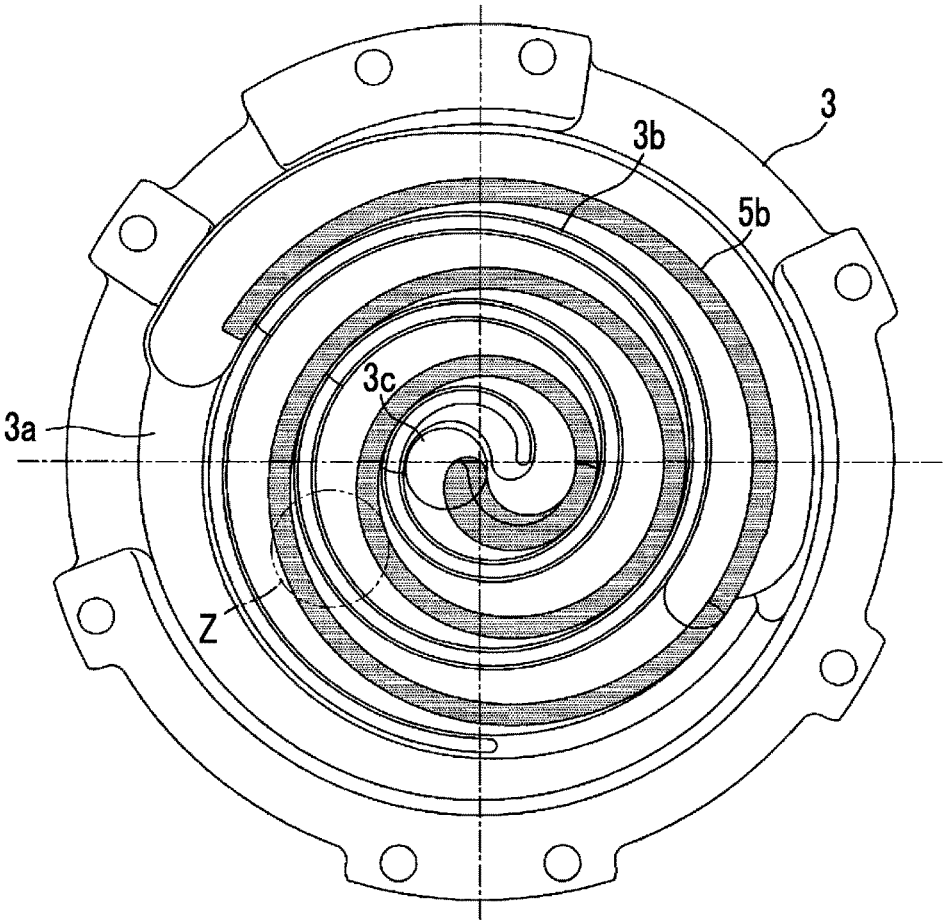
FIG. 1B is a plan view when the fixed scroll is viewed from a wall side.

In FIGS. 1A and 1B, a fixed scroll (first scroll member) 3 and an orbiting scroll (second scroll member) 5 of a scroll compressor (scroll fluid machine) 1 are shown. For example, the scroll compressor 1 is used as a compressor which compresses a gas refrigerant (fluid) which performs a refrigerating cycle of an air conditioner or the like.

Each of the fixed scroll 3 and the orbiting scroll 5 is a metal compression mechanism which is formed of an aluminum alloy or steel, and is accommodated in a housing (not shown). The fixed scroll 3 and the orbiting scroll 5 suck a fluid, which is introduced into the housing, from an outer peripheral side, and discharge the compressed fluid from a discharge port 3*c* positioned at a center of the fixed scroll 3 to the outside.

The fixed scroll 3 is fixed to the housing, and as shown in FIG. 1A, includes an approximately disk-shaped end plate (first end plate) 3*a*, and a spiral wall (first wall) 3*b* which is erected on one side surface of the end plate 3*a*. The orbiting scroll 5 includes an approximately disk-shaped end plate (second end plate) 5*a* and a spiral wall (second wall) 5*b* which is erected on one side surface of the end plate 5*a*. For example, a spiral shape of each of the walls 3*b* and 5*b* is defined by using an involute curve or an Archimedes curve.

The fixed scroll 3 and the orbiting scroll 5 are assembled to each other such that centers thereof are separated from each other by an orbiting radius ρ, the walls 3*b* and 5*b* mesh with each other with phases deviated from each other by 180°, and a slight clearance (tip clearance) in a height direction is provided in the room temperature between tooth tips and tooth bottoms of the walls 3*b* and 5*b* of both scrolls. Accordingly, a plurality pairs of compression chambers which are formed to be surrounded by the end plates 3*a* and 5*a* and the walls 3*b* and 5*b* are symmetrically formed about a scroll center between both scrolls 3 and 5. The orbiting scroll 5 performs a revolution orbiting movement around the fixed scroll 3 by a rotation prevention mechanism such as an Oldham ring (not shown).

As shown in FIG. 1A, an inclined portion is provided, in which an inter-facing surface distance L between both end plates 3*a* and 5*a* facing each other continuously decrease from an outer peripheral side of each of the spiral walls 3*b* and 5*b* toward an inner peripheral side thereof.

Figure 2:
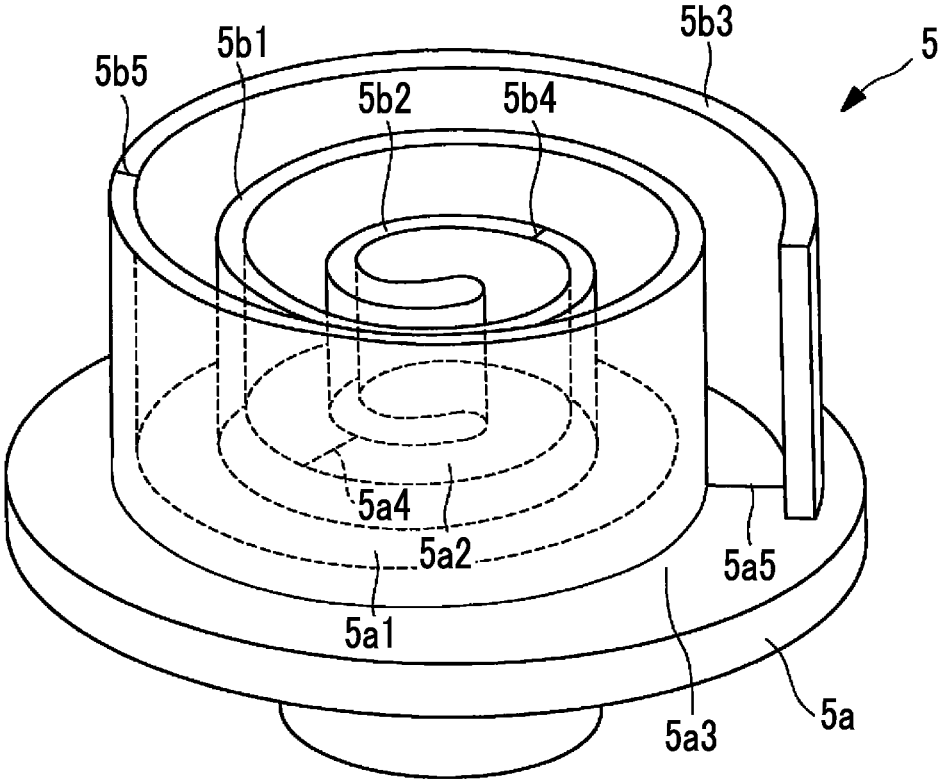
FIG. 2 is a perspective view showing the orbiting scroll of FIGS. 1A and 1B.

As shown in FIG. 2, in the wall 5*b* of the orbiting scroll 5, a wall inclined portion 5*b*1 whose height continuously decreases from an outer peripheral side toward an inner peripheral side is provided. In a tooth bottom surface of the fixed scroll 3 facing a tooth tip of the wall inclined portion 5*b*1, an end plate inclined portion 3*a*1 (refer to FIG. 1A) which is inclined according to an inclination of the wall inclined portion 5*b*1 is provided. A continuously inclined portion is constituted by the wall inclined portion 5*b*1 and the end plate inclined portion 3*a*1. Similarly, a wall inclined portion 3*b*1 whose height is continuously inclined from the outer peripheral side toward the inner peripheral side is provided on the wall 3*b* of the fixed scroll 3, and an end plate inclined portion 5*a*1 facing a tooth tip of the wall inclined portion 3*b*1 is provided on the end plate 5*a* of the orbiting scroll 5.

In addition, the meaning of the continuity in the inclined portion in the present embodiment is not limited to a smoothly connected inclination but also includes an inclined portion in which small step portions inevitably generated during processing are connected to each other in a stepwise fashion and the inclined portion is continuously inclined as a whole. However, the inclined portion does not include a large step portion such as a so-called stepped scroll.

Coating is applied to the wall inclined portions 3*b*1 and 5*b*1 and/or the end plate inclined portions 3*a*1 and 5*al*. For example, the coating includes manganese phosphate processing, nickel phosphorus plating, or the like.

As shown in FIG. 2, wall flat portions 5*b*2 and 5*b*3 each having a constant height are respectively provided on the innermost peripheral side and the outermost peripheral side of the wall 5*b* of the orbiting scroll 5. Each of the wall flat portions 5*b*2 and 5*b*3 is provided over a region of 180° around a center O2 (refer to FIG. 1A) of the orbiting scroll 5. Wall inclined connection portions 5*b*4 and 5*b*5 which become curved portions are respectively provided at positions at which the wall flat portions 5*b*2 and 5*b*3 and the wall inclined portion 5*b*1 are connected to each other.

Similarly, in the tooth bottom of the end plate 5*a* of the orbiting scroll 5, end plate flat portions 5*a*2 and 5*a*3 each having a constant height are provided. Each of the end plate flat portions 5*a*2 and 5*a*3 is provided over a region of 180° around the center of the orbiting scroll 5. End plate inclined connection portions 5*a*4 and 5*a*5 which become curved portions are respectively provided at positions at which the end plate flat portions 5*a*2 and 5*a*3 and the end plate inclined portion 5*a*1 are connected to each other.

Figure 3:
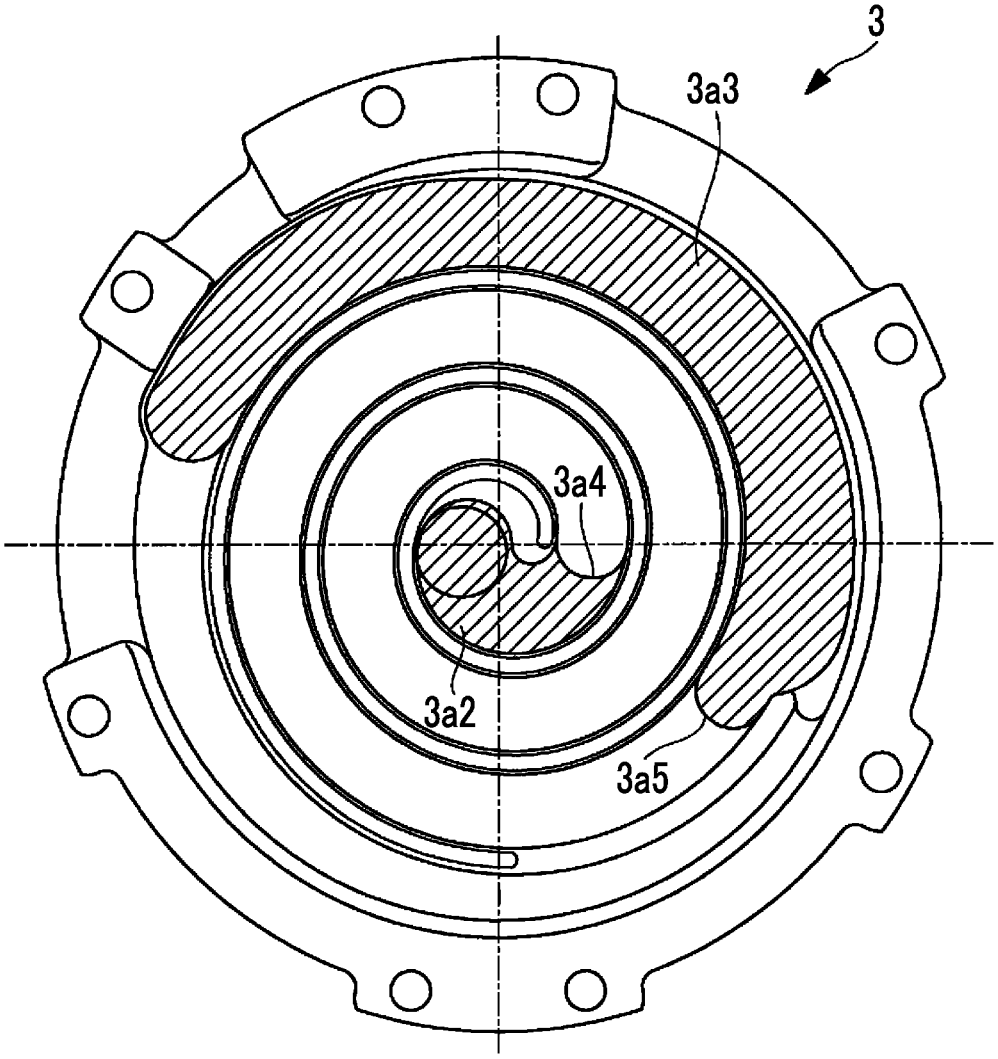
FIG. 3 is a plan view showing an end plate flat portion provided in the fixed scroll.
Figure 4:
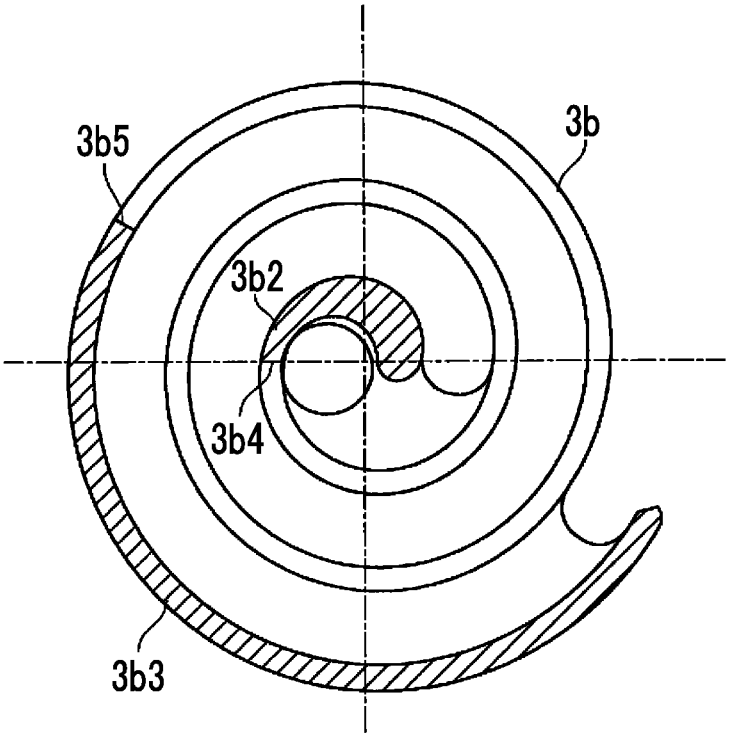
FIG. 4 is a plan view showing a wall flat portion provided in the fixed scroll.

As shown by hatching in FIGS. 3 and 4, similarly to the orbiting scroll 5, in the fixed scroll 3, end plate flat portions 3*a*2 and 3*a*3, wall flat portions 3*b*2 and 3*b*3, end plate inclined connection portions 3*a*4 and 3*a*5, and wall inclined connection portions 3*b*4 and 3*b*5 are provided.

Figure 5:
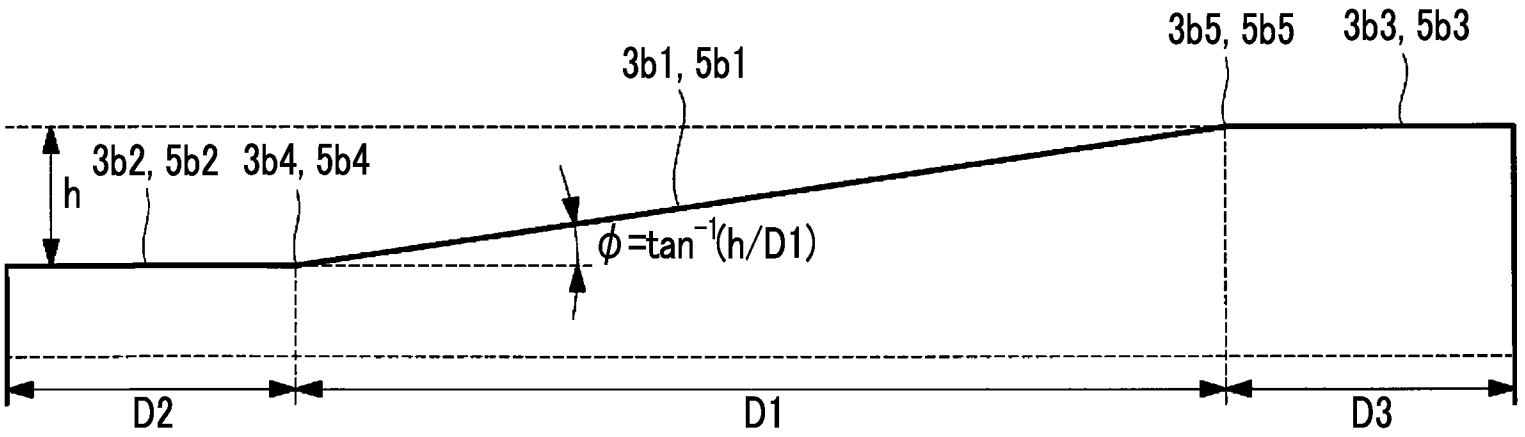
FIG. 5 is a schematic view showing a wall which is displayed to extend in a spiral direction.

FIG. 5 shows the walls 3*b* and 5*b* which are displayed to extend in a spiral direction. As shown in FIG. 5, the wall flat portions 3*b*2 and 5*b*2 on the innermost peripheral side are provided over a distance D2, and the wall flat portions 3*b*3 and 5*b*3 on the outermost peripheral side are provided over a distance D3. Each of the distance D2 and the distance D3 is a length corresponding to the region which becomes 180° around each of the centers O1 and O2 of the respective scrolls 3 and 5. The wall inclined portions 3*b*1 and 5*b*1 are provided over the distance D1 between the wall flat portions 3*b*2 and 5*b*2 on the innermost peripheral side and the wall flat portions 3*b*3 and 5*b*3 on the outermost peripheral side. If a height difference between each of the wall flat portions 3*b*2 and 5*b*2 on the innermost peripheral side and each of the wall flat portions 3*b*3 and 5*b*3 on the outermost peripheral side is defined as h, an inclination φ of each of the wall inclined portions 3*b*1 and 5*b*1 is represented by the following Expression.

$$\varphi=\tan^{-1}(h/D1) \quad (1)$$

In this way, the inclination φ of the inclined portion is constant in a circumferential direction in which each of the spiral walls 3*b* and 5*b* extends.

Figure 6:
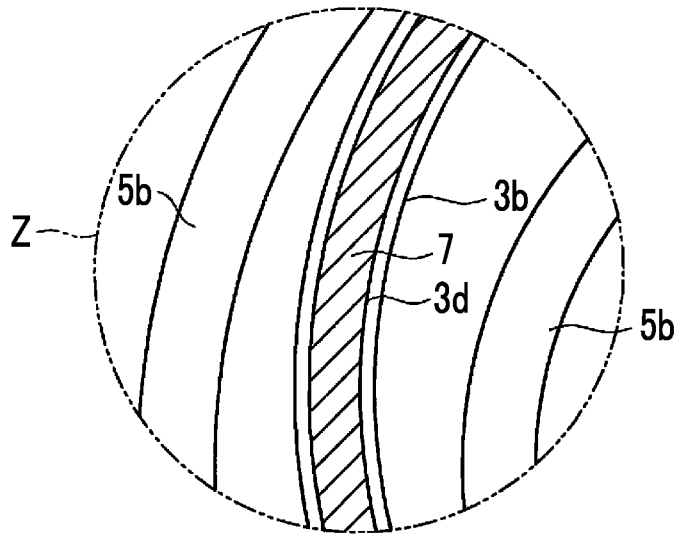
FIG. 6 is a partially enlarged view showing a region indicated by a reference sign Z in FIG. 1B in an enlarged manner.

FIG. 6 is an enlarged view showing a region indicated by a reference sign Z in FIG. 1B in an enlarged manner. As shown FIG. 6, a tip seal 7 is provided in the tooth tip of the wall 3*b* of the fixed scroll 3. The tip seal 7 is formed of a resin such as Polyphenylenesulfide (PPS) and comes into contact with the tooth bottom of the end plate 5*a* of the facing orbiting scroll 5 so as to perform sealing for a fluid. The tip seal 7 is accommodated in a tip seal groove 3*d* which is formed on the tooth tip of the wall 3*b* in the circumferential direction. A compressed fluid enters the tip seal groove 3*d*, presses the tip seal 7 from a rear surface thereof to push the tip seal 7 toward the tooth bottom side, and thus, the tip seal 7 comes into contact with the facing the tooth bottom. In addition, a tip seal is also provided in the tooth tip of the wall 5*b* of the orbiting scroll 5.

Figure 7A:
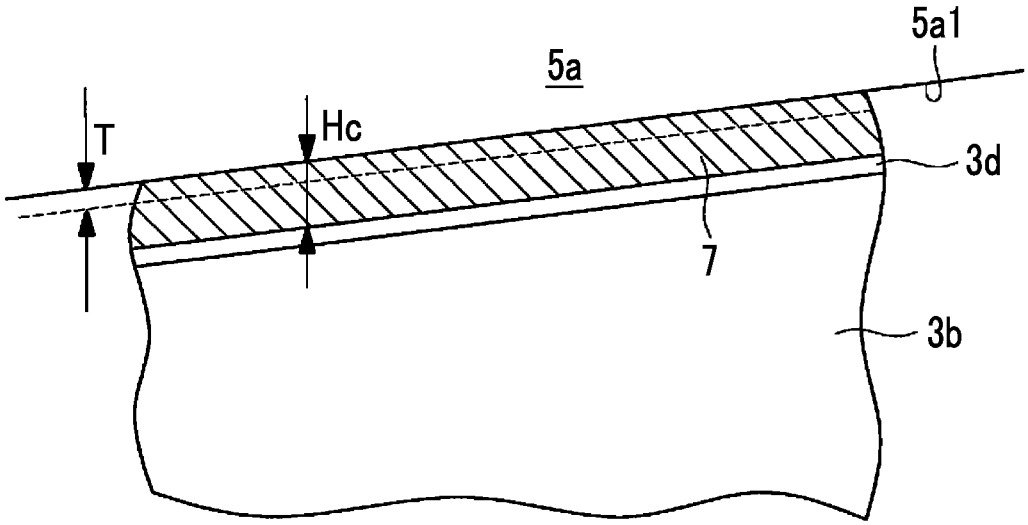
FIG. 7A is a side view showing a tip seal clearance of a portion shown in FIG. 6 and a state where the tip seal clearance relatively decreases.
Figure 7B:
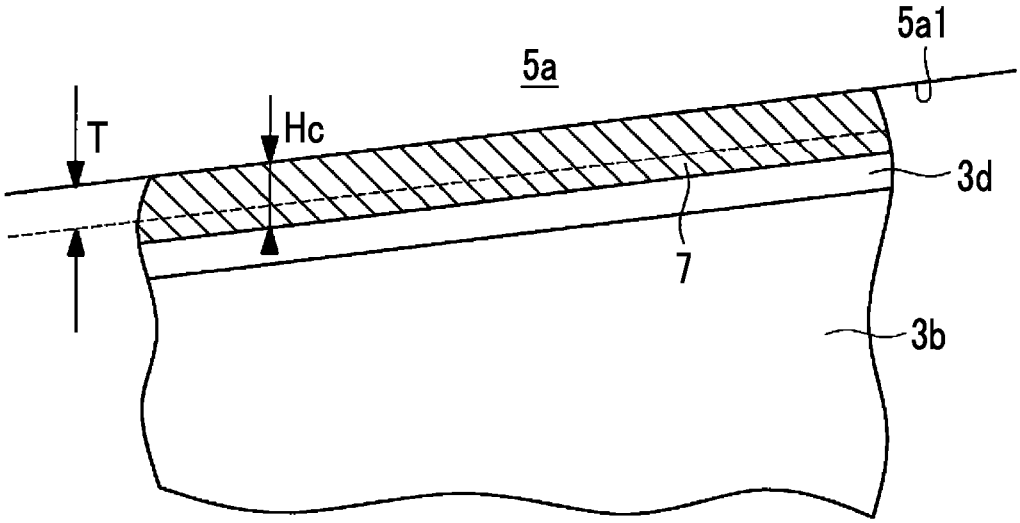
FIG. 7B is a side view showing the tip seal clearance of the portion shown in FIG. 6 and a state where the tip seal clearance relatively increases.

As shown in FIGS. 7A and 7B, a height Hc of the tip seal 7 in the height direction of the wall 3*b* is constant in the circumferential direction.

If both the scrolls 3 and 5 perform the revolution orbiting movement relative to each other, the positions of the tooth tip and the tooth bottom are relatively deviated by an orbiting diameter (orbiting radius ρ×2). In the inclined portion, the tip clearance between the tooth tip and the tooth bottom is changed due to the positional deviation between the tooth tip and the tooth bottom. For example, in FIG. 7A, a tip clearance T is small, and in FIG. 7B, the tip clearance T is large. Even when the tip clearance T is changed by an orbiting movement, the tip seal 7 is pressed toward the tooth bottom side of the end plate 5*a* by the compressed fluid from the rear surface, and the tip seal 7 can follow the tooth bottom so as to perform sealing for the tooth bottom.

Figure 8:
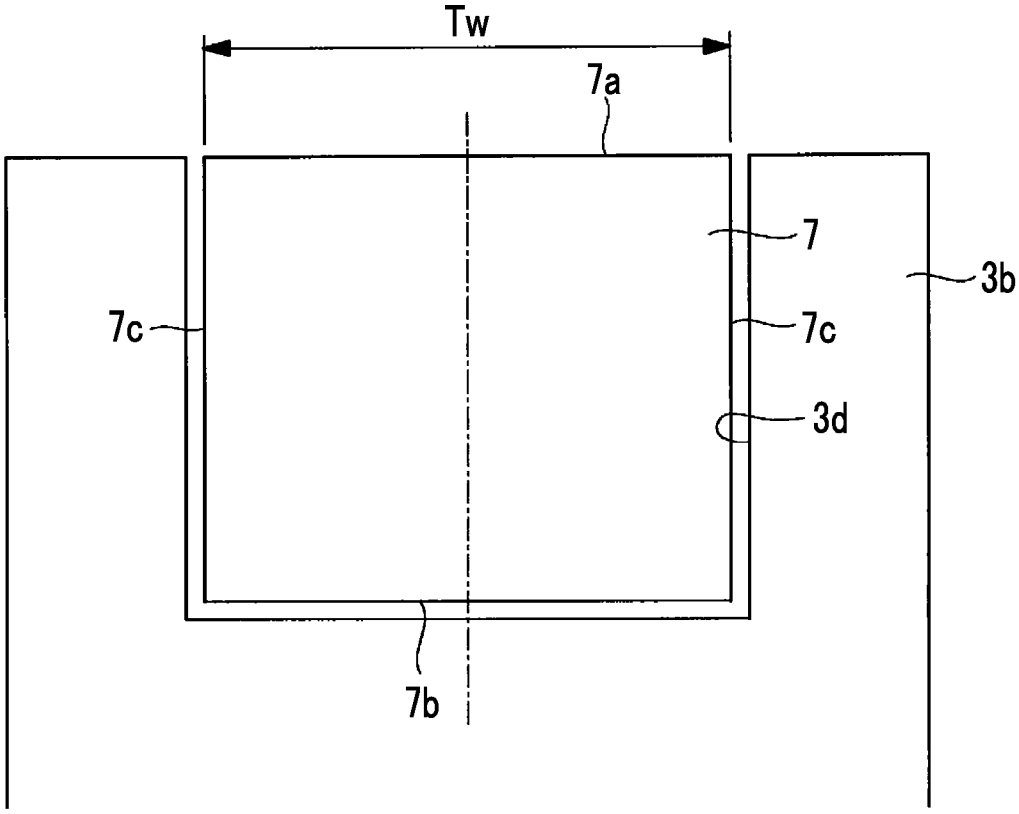
FIG. 8 is a horizontal sectional view around a tooth tip in the wall.

FIG. 8 is a horizontal sectional view around the tooth tip when viewed from a sectional plane of the wall 3*b* of the fixed scroll 3 orthogonal in the spiral direction. In addition, the tooth tip of the orbiting scroll 5 and the tip seal 7 are similarly configured. The tip seal 7 is accommodated in the tip seal groove 3*d* formed on the tip of the wall 3*b*. A horizontal cross section of the tip seal 7 has a substantially rectangular shape, and includes a facing end plate side surface, that is, tooth tip side surface 7*a*, a back surface 7*b*, and side surfaces 7*c*. The surface 7*a* of the tip seal 7 comes into contact with a tooth bottom of the facing end plate so as to perform sealing.

Figure 9:
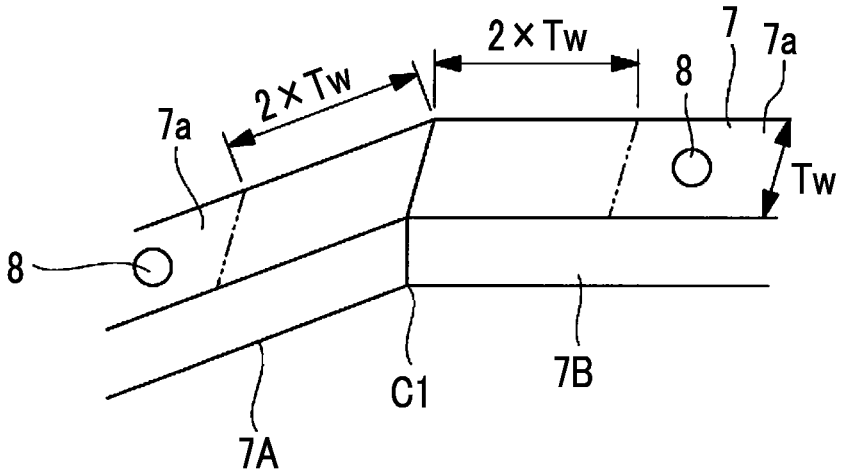
FIG. 9 is a perspective view showing a periphery of a connection portion between an inclined portion and a flat portion of a tip seal.

FIG. 9 shows a periphery of a connection region between a tip seal inclined portion 7A and a tip seal flat portion 7B of the tip seal 7. The tip seal inclined portion 7A is installed in the wall inclined portions 3*b*1 and 5*b*1 (refer to FIG. 5), and the tip seal flat portion 7B is installed in the wall flat portions 3*b*2, 3*b*3, 5*b*2, and 5*b*3 (refer to FIG. 5).

The tip seal inclined portion 7A and the tip seal flat portion 7B are integrally formed and are fixed to each other at a connection position C1. Moreover, in the connection position C1, the surface 7*a* and the back surface 7*b* may be chamfered so as to be smoothly connected to each other.

A plurality of concave portions 8 are formed on the surface 7*a* of the tip seal 7 at predetermined intervals along a longitudinal direction of the tip seal 7. When the tip seal 7 is resin-molded and released from a mold, each concave portion 8 is formed as a trace of a head shape of an extrusion pin on the surface 7*a* of the tip seal 7 when the tip seal 7 is pressed by the extrusion pin and taken out of the mold.

As described with reference to FIGS. 7A and 7B, the tip clearance T is changed according to the orbiting movement of the scrolls 3 and 5, the tip seal inclined portion 7A moves toward or away from the facing tooth bottom. Accordingly, repeated stress is generated at the connection position C1 between the tip seal inclined portion 7A and the tip seal flat portion 7B, due to bending. In consideration of this, as shown in FIG. 9, each concave portion 8 is provided so as to avoid the adjacent regions across the connection position C1. The adjacent region is set to a region which is twice tip seal width Tw, which is a dimension orthogonal to the longitudinal direction of the tip seal 7, away from the connection position C1. Accordingly, the concave portion 8 is provided at a position away from the connection position C1 by twice or more tip seal width Tw.

The above-described scroll compressor 1 is operated as follows. The orbiting scroll 5 performs the revolution orbiting movement around the fixed scroll 3 by a drive source such as an electric motor (not shown). Accordingly, the fluid is sucked from the outer peripheral sides of the respective scrolls 3 and 5, and the fluid is taken into the compression chambers surrounded by the respective walls 3*b* and 5*b* and the respective end plates 3*a* and 5*a*. The fluid in the compression chambers is sequentially compressed while being moved from the outer peripheral side toward the inner peripheral side, and finally, the compressed fluid is discharged from a discharge port 3*c* formed in the fixed scroll 3. When the fluid is compressed, the fluid is compressed in the height directions of the walls 3*b* and 5*b* in the inclined portions formed by the end plate inclined portions 3*a*1 and 5*a*1 and the wall inclined portions 3*b*1 and 5*b*1, and thus, the fluid is three-dimensionally compressed.

According to the present embodiment, the following operational effects are exerted. The concave portion 8 is formed at the position avoiding the adjacent region between the tip seal inclined portion 7A and the tip seal flat portion 7B, and thus, the repeated stress in the adjacent region is reduced, and a risk of damages in the adjacent region can be reduced.

Moreover, the configuration in which the concave portions 8 are formed on the surface 7*a* of the tip seal 7 is described. However, the concave portion 8 may be provided on the back surface 7*b* or the side surface 7*c* of the tip seal 7.

Figure 10:
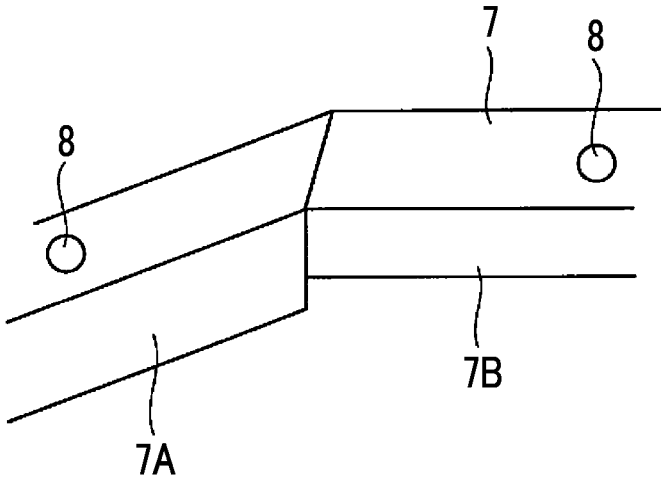
FIG. 10 is a perspective view showing a modification example of FIG. 9.

In addition, as shown in FIG. 10, in a modification example of the present embodiment, a height of the tip seal inclined portion 7A may be set higher than a height of the tip seal flat portion 7B, that is, a thickness of the tip seal inclined portion 7A may increase to improve wear resistance.

Moreover, the tip seal inclined portion 7A may use a material having the wear resistance higher than that of the tip seal flat portion 7B. For example, PolyEtherEtherKetone (PEEK) or polytetrafluoroethylene (PTFE) may be applied to the tip seal inclined portion 7A, or Diamond-LikeCarbon (DLC) coating or PTFE coating may be applied to a base material such as Polyphenylene sulfide (PPS). In this case, PPS or the like is used as a material of the tip seal flat portion 7B.

In addition, the tip seal 7 may be divided into the tip seal inclined portion 7A and the tip seal flat portion 7B at the connection position C1 therebetween. Accordingly, it is possible to avoid occurrence of the repeated stress due to the bending at the connection position C1.

Figure 11:
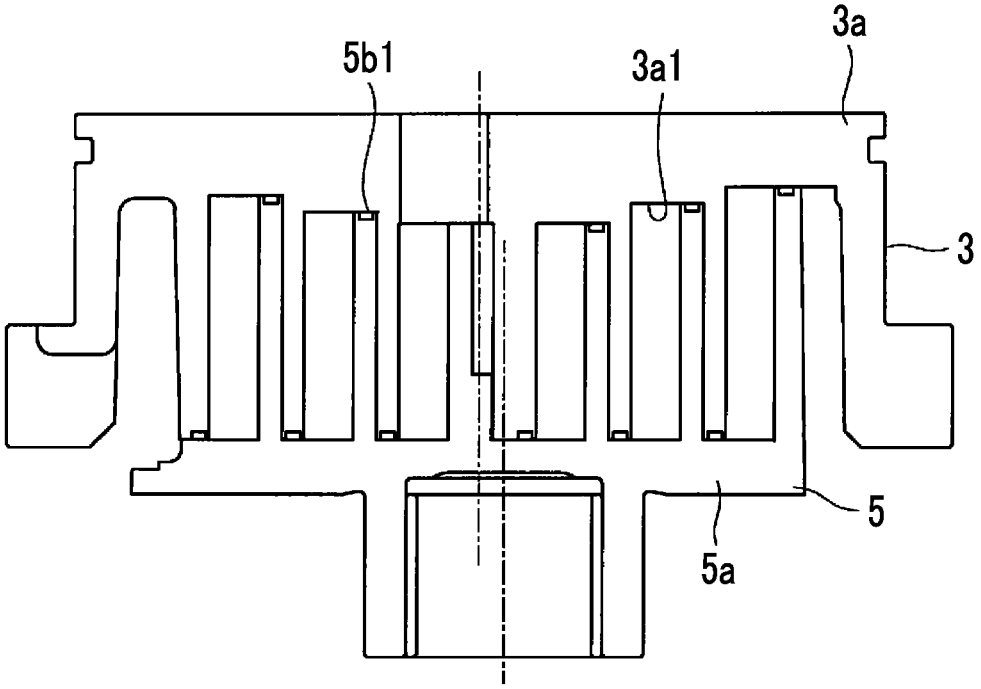
FIG. 11 is a longitudinal section view showing a combination with a scroll which does not have a step portion.
Figure 12:
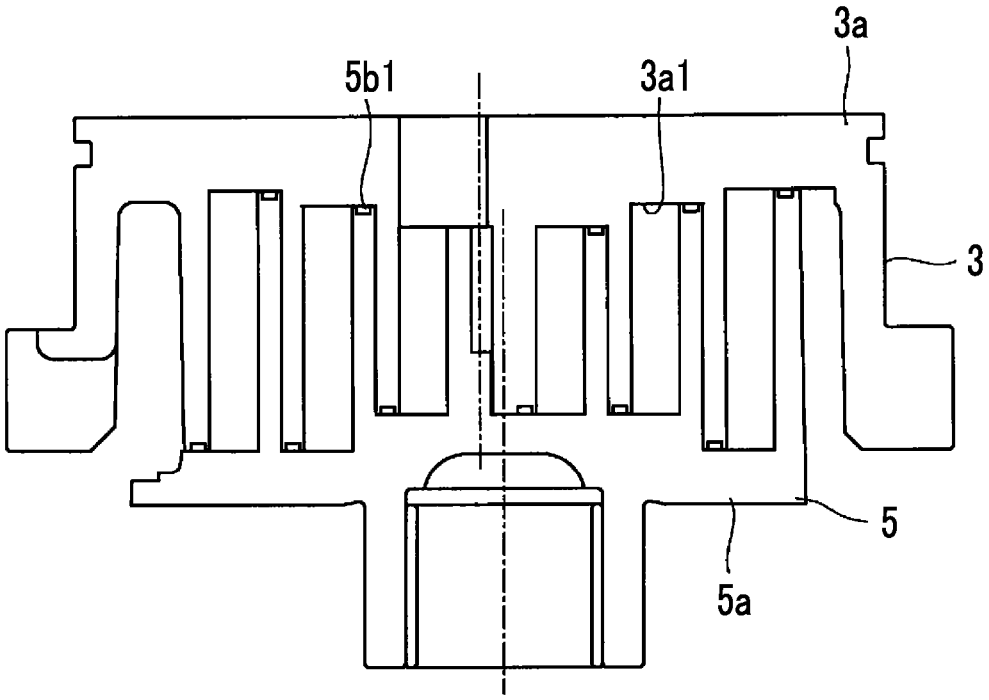
FIG. 12 is a longitudinal section view showing a combination with a stepped scroll.

Moreover, in the present embodiment, although the end plate inclined portions 3*a*1 and 5*a*1 and the wall inclined portions 3*b*1 and 5*b*1 are provided on both the scrolls 3 and 5. However, they may be provided in any one of the scrolls 3 and 5. Specifically, as shown in FIG. 11, in a case where the wall inclined portion 5*b*1 is provided in one wall (for example, orbiting scroll 5) and the end plate inclined portion 3*a*1 is provided in the other end plate 3*a*, the other wall and one end plate 5*a* may be flat. In addition, as shown in FIG. 12, a shape combined with a stepped shape of the related art may be adopted, that is, the shape in which the end plate inclined portion 3*a*1 is provided in the end plate 3*a* of the fixed scroll 3 may be combined with a shape in which the step portion is provided in the end plate 5*a* of the orbiting scroll 5.

In the present embodiment, the wall flat portions 3*b*2, 3*b*3, 5*b*2, and 5*b*3 and the end plate flat portions 3*a*2, 3*a*3, 5*a*2, and 5*a*3 are provided. However, the flat portions on the inner peripheral side and/or the outer peripheral side may be omitted, and the inclined portion may be provided so as to extend to the entire walls 3*b* and 5*b*.

In the present embodiment, the scroll compressor is described. However, the present invention can be applied to a scroll expander which is used as an expander.

REFERENCE SIGNS LIST

1: scroll compressor (scroll fluid machine)
3: fixed scroll (first scroll member)
3*a*: end plate (first end plate)
3*a*1: end plate inclined portion
3*a*2: end plate flat portion
3*a*3: end plate flat portion
3*a*4: end plate inclined connection portion
3*a*5: end plate inclined connection portion
3*b*: wall (first wall)
3*b*1: wall inclined portion
3*b*2: wall flat portion
3*b*3: wall flat portion
3*b*4: wall inclined connection portion
3*b*5: wall inclined connection portion
3*c*: discharge port
3*d*: tip seal groove (groove portion)
5: orbiting scroll (second scroll member)
5*a*: end plate (second end plate)
5*a*1: end plate inclined portion
5*a*2: end plate flat portion
5*a*3: end plate flat portion
5*a*4: end plate inclined connection portion
5*a*5: end plate inclined connection portion
5*b*: wall (second wall)
5*b*1: wall inclined portion
5*b*2: wall flat portion
5*b*3: wall flat portion
5*b*4: wall inclined connection portion
5*b*5: wall inclined connection portion
7: tip seal
7*a*: surface
7*b*: back surface 7*c*: side surface
7A: tip seal inclined portion
7B: tip seal flat portion
8: concave portion
C1: connection position
L: inter-facing surface distance
T: tip clearance
Tw: tip seal width
φ: inclination

The invention claimed is:

1. A tip seal which is installed in a groove portion formed on a tooth tip of a spiral first wall and a spiral second wall of a scroll fluid machine and is formed of a resin, the scroll fluid machine comprising: a first scroll member having a first end plate on which the spiral first wall is provided; a second scroll member having a second end plate on which the spiral second wall is provided, the second end plate being disposed to face the first end plate and the spiral second wall meshing with the spiral first wall such that the second scroll member performs a revolution orbiting movement relative to the first scroll member, the tip seal comprising:

a tip seal inclined portion which is installed in the groove portion of each of a wall inclined portion of the spiral first wall and a wall inclined portion of the spiral second wall whose heights are continuously changed in a spiral direction; and a tip seal flat portion which is installed in the groove portion of each of a wall flat portion of the spiral first wall and a wall flat portion of the spiral second wall whose heights are constant in the spiral direction and is adjacent to the tip seal inclined portion, wherein the tip seal inclined portion is inclined to the tip seal flat portion so as to come into contact with a tooth bottom of each of an end plate inclined portion of the first end plate and an end plate inclined portion of the second end plate even if a tip clearance between the tooth tip of each of the wall inclined portion of the spiral first wall and the wall inclined portion of the spiral second wall and the tooth bottom of each of the end plate inclined portion of the first end plate and the end plate inclined portion of the second end plate is changed during the revolution orbiting movement; and wherein a concave portion is formed on a surface of the tip seal at a position away from a connection position between the tip seal flat portion and the tip seal inclined portion by twice or more width of the tip seal flat portion, the concave portion being recessed from the surface of the tip seal.

2. The tip seal according to claim 1, wherein a height of the tip seal inclined portion is higher than a height of the tip seal flat portion.

3. The tip seal according to claim 2, wherein the tip seal inclined portion is formed of a material having wear resistance higher than that of the tip seal flat portion.

4. The tip seal according to claim 2, wherein the tip seal is divided into the tip seal inclined portion and the tip seal flat portion at a connection position therebetween.

5. A scroll fluid machine comprising:

a first scroll member having a first end plate on which a spiral first wall is provided;

a second scroll member having a second end plate on which a spiral second wall is provided, the second end plate being disposed to face the first end plate and the spiral second wall meshing with the spiral first wall such that the second scroll member performs a revolution orbiting movement relative to the first scroll member; and an inclined portion in which an inter-facing surface distance between the first end plate and the second end plate facing each other continuously decreases from outer peripheral sides of the spiral first wall and the spiral second wall toward inner peripheral sides thereof, wherein the tip seal according to claim 3 which comes into contact with a facing tooth bottom to perform sealing for a fluid is provided in the groove portion formed on each tooth tip of the spiral first wall and the spiral second wall corresponding to the inclined portion.

6. The tip seal according to claim 1, wherein the tip seal inclined portion is formed of a material having wear resistance higher than that of the tip seal flat portion.

7. The tip seal according to claim 6, wherein the tip seal is divided into the tip seal inclined portion and the tip seal flat portion at a connection position therebetween.

8. A scroll fluid machine comprising:

a first scroll member having a first end plate on which a spiral first wall is provided;

a second scroll member having a second end plate on which a spiral second wall is provided, the second end plate being disposed to face the first end plate and the spiral second wall meshing with the spiral first wall such that the second scroll member performs a revolution orbiting movement relative to the first scroll member; and an inclined portion in which an inter-facing surface distance between the first end plate and the second end plate facing each other continuously decreases from outer peripheral sides of the first wall and the second wall toward inner peripheral sides thereof, wherein the tip seal according to claim 4 which comes into contact with a facing tooth bottom to perform sealing for a fluid is provided in a groove portion formed on each tooth tip of the spiral first wall and the spiral second wall corresponding to the inclined portion.

9. The tip seal according to claim 1, wherein the tip seal is divided into the tip seal inclined portion and the tip seal flat portion at a connection position therebetween.

10. A scroll fluid machine comprising:

a first scroll member having a first end plate on which a spiral first wall is provided;

a second scroll member having a second end plate on which a spiral second wall is provided, the second end plate being disposed to face the first end plate and the spiral second wall meshing with the spiral first wall such that the second scroll member performs a revolution orbiting movement relative to the first scroll member; and an inclined portion in which an inter-facing surface distance between the first end plate and the second end plate facing each other continuously decreases from outer peripheral sides of the spiral first wall and the spiral second wall toward inner peripheral sides thereof, wherein the tip seal according to claim 5 which comes into contact with a facing tooth bottom to perform sealing for a fluid is provided in the groove portion formed on each tooth tip of the spiral first wall and the spiral second wall corresponding to the inclined portion.

11. A scroll fluid machine comprising:

a first scroll member having a first end plate on which a spiral first wall is provided;

a second scroll member having a second end plate on which a spiral second wall is provided, the second end plate being disposed to face the first end plate and the spiral second wall meshing with the spiral first wall such that the second scroll member performs a revolution orbiting movement relative to the first scroll member; and an inclined portion in which an inter-facing surface distance between the first end plate and the second end plate facing each other continuously decreases from outer peripheral sides of the spiral first wall and the spiral second wall toward inner peripheral sides thereof, wherein the tip seal according to claim 1 which comes into contact with a facing tooth bottom to perform sealing for a fluid is provided in the groove portion formed on each tooth tip of the spiral first wall and the spiral second wall corresponding to the inclined portion.

* * * * *